United States Patent [19]

Rodakis et al.

[11] Patent Number: 4,992,353

[45] Date of Patent: Feb. 12, 1991

[54] IMAGE-RECEIVING ELEMENT FOR ADHESIVELY BONDABLE DIFFUSION TRANSFER PHOTOGRAPH

[75] Inventors: John M. Rodakis, Lexington; Walter Bleszinski, Jr., Andover, both of Mass.

[73] Assignee: Polaroid Corporation, Cambridge, Mass.

[21] Appl. No.: 328,631

[22] Filed: Mar. 27, 1989

[51] Int. Cl.[5] ..... G03C 5/54; G03C 1/90; G03C 11/12

[52] U.S. Cl. ..... 430/213; 430/10; 430/207; 430/212; 430/237; 430/259; 430/262; 430/263

[58] Field of Search ..... 430/10, 207, 212, 213, 430/237, 259, 262, 263

[56] References Cited

U.S. PATENT DOCUMENTS

| | | | |
|---|---|---|---|
| 3,520,682 | 7/1970 | Gross | 96/27 |
| 3,520,758 | 7/1970 | Weist | 161/5 |
| 4,033,770 | 7/1977 | De Haes et al. | 96/28 |
| 4,123,309 | 10/1978 | Perrington et al. | 156/234 |
| 4,285,999 | 8/1981 | Olivieri et al. | 428/40 |
| 4,464,454 | 8/1984 | Vogt | 430/256 |
| 4,653,775 | 3/1987 | Raphael et al. | 283/108 |
| 4,808,509 | 2/1989 | Vervloet et al. | 430/207 |

OTHER PUBLICATIONS

"Image Transfer Material", *Research Disclosure*, No. 15513, 3/1977, pp. 8 and 9.

Research Disclosure No. 20040, "Method of Transferring Images by Decalcomania and Materials Formed by this Method", Research Disclosure, Dec. 1980, pp. 569–571.

*Primary Examiner*—Richard L. Schilling

*Attorney, Agent, or Firm*—Louis G. Xiarhos

[57] ABSTRACT

An image-receiving element, adapted to the production of a diffusion transfer photograph adhesively bondable to a substrate material, comprises first and second separable sheet-like support members adhesively bonded to one another by a layer of adhesive therebetween, the adhesivity of the first sheet-like support to the adhesive layer being less than the adhesivity of the second sheet-like support to the adhesive and less than the cohesivity of the adhesive layer. The second sheet-like support member carries on the side thereof opposed from the adhesive layer at least a water-permeable and dyeable image-receiving layer which receives a photographic dye image by diffusion transfer processing. Subsequent to diffusion transfer processing, the first sheet-like member carrying the photographic image is separated from the second sheet-like member with the adhesive layer being preferentially adhered to the opposed side of the second sheet-like member, thereby to provide a diffusion transfer photograph which is adhesively bondable to a substrate material for the enhancement of the decorative or information content thereof.

27 Claims, 1 Drawing Sheet

IMAGE-RECEIVING ELEMENT FOR ADHESIVELY BONDABLE DIFFUSION TRANSFER PHOTOGRAPH

BACKGROUND OF THE INVENTION

This invention relates to an image-receiving element and to diffusion transfer photographic film units. More particularly, it relates to image-receiving elements for use in so-called "peel-apart" diffusion transfer film units and to the production of diffusion transfer photographs which can be adhesively bonded to any of a variety of substrate materials.

The application of pictures, designs, patterns and the like to various substrate materials, to impart a decorative or informational content to the substrate material, has been well known. Thus, using known methods, pictures and designs in the form of decals have been applied from a paper or other carrier material to a permanent substrate of metal, glass, paper, china or the like. Photographic images, including those prepared by conventional processing on photographic papers and by diffusion transfer processing, have also been applied to substrate materials of the aforedescribed type. Examples of methods for affixing photographic image layers from a photographic support material to another substrate material can be found, for example, in U.S. Pat. 3,520,682 (issued July 14, 1970 to Wilson Gross); in U.S. Pat. 4,033,770 (issued July 5, 1977 to L.M. DeHaes et al.); in U.S. Pat. 4,464,454 (issued August 7, 1984 to W. Vogt); and in Disclosure No. 20040, in Research Disclosure, Dec. 1980, pages 569-571.

While there are a variety of methods for applying a photographic layer from one support layer to another substrate material, such methods oftentimes are attended by cumbersome or inefficient operations. Such methods may involve, for example, a soaking or immersion step which is conducted to remove the photographic image layer from its support, as is described, for example, in the aforementioned U.S. Pat. 3,520,682. In addition, there are manipulative problems associated with the handling of the thin and unsupported image layer and the uniform application of the image layer to the permanent substrate. The layer should be applied evenly, without wrinkles or entrapment of air, so as to appear to be an integral part of the permanent substrate.

Methods for affixing a photographic layer to a permanent substrate material oftentimes involve the transfer of a photographic image layer from the support on which the image is formed to another support material. This is accomplished by bringing an image layer (carried on a photographic paper or other support) into adhesive contact with a second support and, then, removing the photographic support by stripping or peeling. Such methods are described, for example, in the aforementioned Research Disclosure and in U.S. Pat. 4,033,770. These methods provide a transferred image which is reversed from the original. This necessitates camera modifications (e.g., mirror reversal modifications) to produce an image which, when viewed from reverse direction, appears to correspond with the original subject. Transfer of the reversed image layer to the permanent substrate also dictates that the original photographic support be transparent so that the image layer can be viewed through the support for correct positioning of the photographic layer onto the permanent support.

A method for transferring an image by decalcomania from a photographic print to a final support so that the transferred image on the final support is not reversed with respect to the original—and so that reverse printing of the original is avoided—is also described in the aforementioned Research Disclosure No. 20040. The method requires adhesion of the emulsion side of a photograph to a temporary support and a soaking or dipping operation for removal of the original support. A second transfer operation is then required to transfer the image layer (for non-reversed viewing) from the temporary support to the permanent carrier.

In the method of aforementioned U.S. Pat. 4,463,454, an information carrier in the form of a card is prepared by bringing an adhesive-coated plastic carrier foil into adhesive contact with the emulsion side of an auxiliary carrier carrying an image-bearing emulsion layer, and removing the auxiliary carrier. A further prepared plastic foil is applied to the side of the emulsion layer previously bonded to the auxiliary carrier, to provide a card comprising the emulsion layer between a pair of plastic foil layers. The method requires, prior to transfer of the emulsion layer, that the auxiliary carrier be pretreated to permit subsequent transfer of the emulsion layer from the auxiliary carrier to the adhesive carrier foil. In addition, the emulsion layer carried by the auxiliary carrier must, for image formation be first exposed, developed, fixed and dried.

It will be appreciated that there will be considerable advantage to an image-receiving element for a film unit which permits the production, by resort to "instant" diffusion transfer processing, of a thin, adhesively bondable photograph which can be simply and reliably affixed to any of a variety of substrate materials for enhancement of the decorative and/or informational content thereof.

SUMMARY OF THE INVENTION

It has been found that a thin adhesively bondable photograph—which can be affixed to a variety of substrate materials—can be provided by using, as a support for the image-receiving element of a diffusion transfer film unit of the "peel-apart" type, a lamination of first and second sheet-like support members, the sheet members being separable, such that, an adhesive material therebetween is preferentially adhered to the sheet-like member carrying the image-receiving layer and can, after photographic processing, serve to adhere the resulting photograph to any desired substrate material.

According to a product aspect of the present invention, there is, thus, provided an image-receiving element adapted to the production of a diffusion transfer photograph adhesively bondable to a substrate material, the image-receiving element comprising first and second sheet-like support members adhesively bonded to one another by a layer of adhesive therebetween, the adhesivity of the first sheet-like support to the adhesive layer being less than the adhesivity of the second sheet-like support to the adhesive layer and less than the cohesivity of the adhesive layer. The second sheet-like support member carries on the side thereof opposed from the adhesive layer at least a water-permeable and dyeable image-receiving layer which receives a photographic dye image by diffusion transfer processing. Subsequent to diffusion transfer processing, the first sheet-like member carrying the photographic image is separated from the second sheet-like member with the adhesive layer being preferentially adhered to the opposed side of the second sheet-like member—to provide a diffusion transfer photograph adhesively bondable to a substrate material.

According to another product aspect of the present invention, there is provided a photographic diffusion transfer film unit of the "peel-apart" type comprising, in combination, a photosensitive element including at least a silver halide emulsion layer having associated therewith a diffusion transfer process dye-image providing material; an alkaline processing composition; and an image-receiving element, as aforedescribed.

According to a method aspect of the present invention, there is provided a method for applying an adhesively bondable photograph to a substrate material for the enhancement of the decorative or informational content thereof which comprises the steps of imagewise exposing a photosensitive element including a support and at least a silver halide emulsion layer having associated therewith a diffusion transfer process dye-image providing material; superposing the exposed photosensitive element in face-to-face relation with the image-receiving layer of an image-receiving element having first and second separable sheet-like support members of the character aforedescribed; applying an aqueous alkaline processing composition between the superposed photosensitive and image-receiving elements; separating said elements after a predetermined imbibition period and after development and dye image formation to provide a diffusion transfer photograph; separating the separable sheet-like support members of the image-receiving element to provide an adhesively bondable photograph; and adhering said adhesively bondable photograph to said substrate material for the enhancement of said decorative or informational content thereof.

For a fuller understanding of the nature and objects of the invention, reference should be had to the following detailed description taken in conjunction with the accompanying drawings.

DETAILED DESCRIPTION OF THE INVENTION

As mentioned previously, the present invention embodies the use of an image-receiving element in a photographic diffusion transfer film unit and process wherein the support material for the image-receiving element comprises a two-sheet composite support material, the sheets being separable for formation of an adhesively bondable photograph. The manner in which the image-receiving element is structured and used in a diffusion transfer process and the manner in which an adhesively bondable photograph can be obtained therefrom for use in the enhancement of the informational or decorative content of a substrate material will be better understood by reference to the description that follows.

Figure 1:
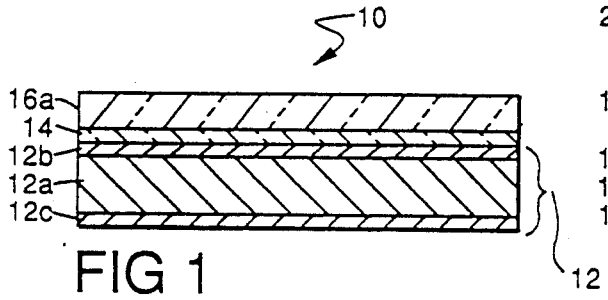
FIG. 1 is a diagrammatic cross-sectional view of a two-sheet composite support material comprising an opaque sheet laminated to a thin transparent sheet, the two-sheet composite being useful as a support material in the production of an image-receiving element of the invention.

Referring to FIG. 1, there is shown a preferred two-sheet composite support material 10, suited to use in the production of an image-receiving element of the invention. Composite support material 10 comprises a first sheet-like support member 12 bonded by adhesive layer 14 to a second sheet-like support member **16*a*. The nature of each of support members 12 and 16*a* can vary, having in mind the particular manner in which the image-receiving element to be prepared therefrom is to be used in a diffusion transfer process and the particular nature of the adhesively bondable photograph desirably obtained therefrom. The adhesive material 14** will, however, be such as to permit the separation of such support members in a manner which provides the desired photograph with the adhesive layer on the side of the support which is opposed from the image-bearing side.

Figure 2:
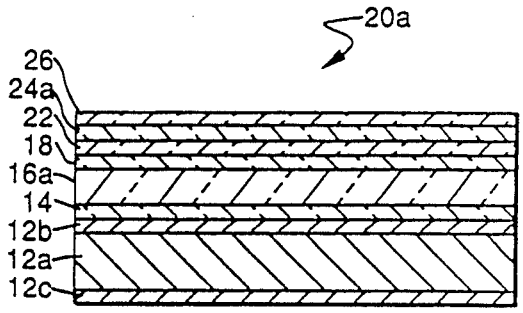
FIG. 2 is a diagrammatic cross-sectional view of an image-receiving element of the invention comprising the two-sheet composite support material having image-receiving layers thereon.

Support members 12 and **16*a* serve in combination as the support for a plurality of layers to be coated onto sheet member 16*a*, as shown in image-receiving element 20*a* of FIG. 2. In general, each of sheet members 12 and 16*a* can comprise rigid or flexible materials which can vary in thickness. Suitable materials for such sheet members include paper; polyolefin-coated papers, such as polyethylene-coated and polypropylene-coated papers; polymethacrylic acid, methyl and ethyl esters; vinyl chloride polymers; polyvinyl acetal; polymeric resins such as polyethylene; polyamides such as nylon; polyesters such as polymeric films derived from ethylene glycol and terephthalic acid; and cellulosic polymers such as cellulose acetate, triacetate, nitrate, propionate, butyrate, acetate-propionate or acetate-butyrate. Each of support members 12 and 16*a* can be transparent, opaque or translucent. For example, support member 16*a*** can be transparent or opaque depending upon the desired nature of the resulting photograph, e.g., as a transparency or a reflective print.

Figure 3:
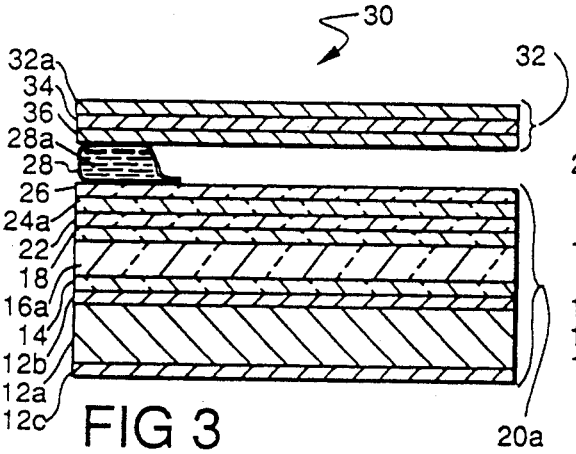
FIG. 3 is a diagrammatic cross-sectional view of a photographic film unit of the invention comprising the image-receiving element of FIG. 2 in combination with a photosensitive element and a rupturable pod containing a photographic processing composition.

Each of sheet members 12 and **16*a* can comprise a single layer of material or a multiple-layer material. Thus, there is shown in FIG. 1, a sheet member material 12 comprising paper core material 12*a*, polymeric layer 12*b* on a first side thereof, and polymeric layer 12*c* on the opposed side. Polymeric layers 12b and 12c can, for example be polyethylene layers and can contain various agents, such as pigments, non-stick or release agents, and curl-correcting agents. In general, it will be preferred that paper core component 12a be provided with a polymeric layer 12b composed of polyethylene or other polymeric material which facilitates the separation of sheet members 12 and 16a, with adhesive layer 14 preferentially adhered to sheet member 16a. Layer 12c can be omitted, if desired, but may be employed for curl correction or for improved handling of composite support material 10 or of image-receiving element 20a prepared therefrom. Good results are obtained using a polyethylene-clad paper support member 12 comprising a paper core 12a, a titanium dioxide-pigmented polyethylene layer 12b and a carbon black-pigmented polyethylene layer 12c. Such a material, in combination with a preferred and thin sheet of polyester 16a, provides a support member which can be readily handled for coating thereon of desired photographic layers and provides an image-receiving element having physical and handling properties adapted to the production of a film unit of the "peel-apart" type which can be processed in commercially available cameras. Film units of this type will typically comprise a photosensitive element, a rupturable pod containing a photographic processing composition, and an image-receiving element, as shown in FIG. 3, and will be processed by passage of the film unit through a pair of in-camera rolls. The preferred support sheet material 12**, as aforedescribed, is especially suited to the production of image-receiving elements for use in film units processed in this manner.

Support member 16a can be a transparent or opaque sheet member, as mentioned previously. Preferably, sheet member 16a will be a transparent sheet material which serves to facilitate the desired positioning of the adhesively bondable photograph onto the substrate material to which the photograph is to be bonded and which only minimally obscures the substrate to which the photograph is laminated. For example, use of transparent sheet member 16a in the production of composite support sheet 10 and image-receiving element 20a permits the production of a photographic transparency which can be laminated to a pre-printed information-bearing document such as a passport, credit card or the like, while only minimally obscuring the informational content of the pre-printed matter.

Support sheet member 16a can comprise a single sheet of material or can be coated on each side with the same or different layers (not shown) to promote adhesion or to facilitate separation of materials coated or laminated thereto. A preferred sheet member 16a comprises a transparent sheet of polyethylene terephthalate, preferably having thin subcoat layers to promote adhesion of photographic layers thereto on one side (such as layers 18, 22, 24a and 26 shown in FIG. 2) and the adhesion of adhesive layer 14 to the opposed side thereof. Preferably, sheet member 16a will be a thin layer so that a photograph prepared therefrom, once bonded to a substrate material, will likely be mutilated or defaced if an attempt is made to delaminate the photograph from the substrate material. This provides an element of security which will be desired in the case of application of the photograph to identification cards, security papers and other information-bearing documents. Good results can be obtained using, for example, a transparent polyester sheet material having a thickness in the range of from about 0.0064 mm to 0.076 mm. Preferably, sheet member 16a will have a thickness of less than about 0.038 mm.

Figure 4:
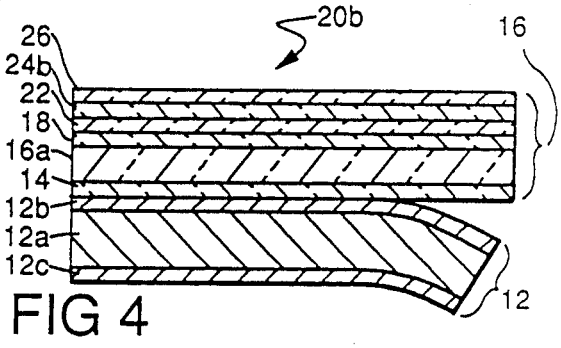
FIG. 4 is a diagrammatic cross-sectional view of an adhesively bondable photograph prepared from the film unit of FIG. 3, by photographic processing and separation therefrom of the photosensitive element and processing composition, the adhesively bondable photograph being shown with one sheet component of the two-sheet composite support material partially removed.

Adhesive material 14 serves an important function in permitting the predetermined separation of the respective sheet members of two-sheet composite material 10. While the chemical nature of adhesive layer 14 is not critical, the layer must function according to certain requirements, i.e., the adhesive material employed between support members 12, and 16a and the nature of the respective surfaces of members 12 and 16a in contact with adhesive layer 14, must be such that support members can be separated with preferential adhesion of adhesive layer 14 to support member 16a. This permits the production of an image-receiving element 20a of FIG. 2 which can be employed in a film unit 30 of FIG. 3 for photographic processing to an image-bearing element 20b and, in turn, a separable adhesively bondable photograph 16, as shown in FIG. 4.

It will be appreciated that adhesion of adhesive material 14 to support members 12 and 16a will depend upon the nature of adhesive material 14 itself and on the nature of each surface of sheet members 12 and 16a contiguous with adhesive layer 14. Suitable support materials 12 and 16a and adhesive material 14 can be selected so that on attempt to separate the support members, adhesive layer 14 will be preferentially adhered to support member 16a. This is accomplished by the adhesivity of support member 12 to adhesive layer 14 being less than the adhesivity of sheet member 16a to adhesive layer 14. In addition, the adhesivity of sheet member 12 to adhesive layer 14 is less than the cohesivity of the adhesive layer.

Suitable adhesive materials for adhesive layer 14 include polymeric adhesive materials prepared by copolymerization of ethylenically unsaturated monomeric materials such as acrylic acid esters, vinyl acetate, ethylene and the like. Polyester, polyamide and polyurethane adhesives can also be employed, if desired. Those skilled in the art can select a suitable adhesive material for predetermined separability of support members 12 and 16a according to the particular nature of each of such support materials. Suitable adhesives are commercially available and include pressure-sensitive adhesives (e.g., those of the aerobically curable and moisture-activatable types), heat-activatable and solvent-activatable adhesives. The choice of a heat-activatable, pressure sensitive or solvent activatable adhesive material will depend largely upon the nature of the surface to which the adhesively bondable photograph is to be applied and compatibility of such surface with the stimulus required for activation of the adhesive material. Heat lamination will be preferred for a secure application of the adhesively bondable photograph to laminable paper or plastic documents in sheet form, in which case, a heat-activatable adhesive will be preferred. Where desired, and where suitable for the particular substrate material, solvent-activatable or pressure-sensitive adhesive materials can be obtained. Adhesive layer 14 can include various additives such as anti-blocking, anti-slip and other agents, for modification of the affinity of the layer to either or both of sheet members 12 and 16a and for facilitation of the desired mode of separation of such sheet members.

A preferred heat-activatable adhesive for lamination of support members 12 and 16a is a polyester-based adhesive such as is commercially available as Adhesive 72-9672 from National Starch Company. The material can be conveniently coated onto support member 12 and dried to adhesive layer 14. Sheet member 16a, for example, polyester sheet material, can be placed into contact with adhesive layer 14 and the resulting sandwich passed through the nip of heated rollers for production of a two-sheet composite support material 10.

Two-sheet composite support material 10 can be used for the production of an image-receiving element 20a, as shown in FIG. 2. Image-receiving element 20a comprises support article 10 of FIG. 1 carrying polymeric acid-reacting layer 18, timing layer 22, image-receiving layer 24a and overcoat layer 26.

Image-receiving layer 24a, timing layer 22 and polymeric acid layer 18 serve important functions in the provision of a diffusion transfer photograph such as is illustrated in FIG. 4. Image-receiving layer 24a will generally comprise a dyeable or dye-receptive material which is permeable to the alkaline processing composition customarily used in photographic diffusion transfer processing. The dyeable image-receiving layer can comprise, for example, materials which heretofore have been found to be useful as image-receiving materials in diffusion transfer photographic processes. Examples of such materials include such dyeable or dye-receptive materials as p-trimethylammonium p-toluene-sulfonate benzal of polyvinyl alcohol, N-methoxy-methyl polyhexamethylene adipamide, polyvinyl alcohol, cross-linked polyvinyl alcohol (i.e., polyvinyl alcohol which has been reacted with a cross-linking agent such as glyoxal or dimethylolurea), mixtures of polyvinyl alcohol and poly-N-vinyl pyrrolidone, and copolymers of vinyl alcohol and N-vinyl pyrrolidone. A particularly preferred material for layer 24a is an admixture of polyvinyl alcohol or gelatin and a dye mordant such as poly-4-vinylpyridine, as disclosed in U.S. Pat. No. 3,148,061 (issued Sept. 18, 1964 to H.C. Haas). Polyvinyl alcohol and poly-4-vinyl-pryidine, in a weight ratio of 3:1 to 1:3, is preferred. Other alkali permeable and dyeable polymeric materials can, however, be suitably employed and examples can be found in U.S. Pat. No. 3,770,439 (issued Nov. 6, 1973 to L.D. Taylor); U.S. Pat. No. 4,080,346 (issued Mar. 31, 1978 to S.F. Bedell); and U.S. Pat. No. 4,322,489 (issued Mar. 30, 1982 to E.H. Land et al.).

Polymeric acid-reacting layer 18 functions in known manner during the processing of a diffusion transfer photograph from image-receiving element 20a. Thus, polymeric acid layer 18 is employed to lower in predetermined manner the environmental pH of the film unit following substantial dye transfer in order to increase image stability and/or adjust the pH from a first pH at which the image dyes are diffusible to a second lower pH at which such image-dyes are not diffusible.

As disclosed in, for example, U.S. Pat. No. 3,362,819 (issued Jan. 9, 1968 to E.H. Land), the polymeric acid-reacting layer may comprise a non-diffusible acid-reacting reagent adapted to lower the pH from the first (high) pH of the processing composition in which the image dyes are diffusible to a second (lower) pH at which they are not. The acid-reacting reagents are preferably polymers which contain acid groups, e.g., carboxylic acid and sulfonic acid groups, which are capable of forming salts with alkali metals or with organic bases; or potentially acid-yielding groups such as anhydrides or lactones. Thus, reduction in the environmental pH of the film unit is achieved by the conduct of a neutralization reaction between the alkali provided by the processing composition and layer 18 which comprises immobilized acid-reactive sites and which functions as a neutralization layer. Preferred polymers for neutralization layer 18 comprise such polymeric acids as cellulose acetate hydrogen phthalate; polyvinyl hydrogen phthalate; polyacrylic acid; polystyrene sulfonic acid; and partial esters of polyethylene/maleic anhydride copolymers.

Polymeric acid-reacting layer 18 can be applied, if desired, by coating support material 12 with an organic solvent-based or water-based coating composition. A preferred polymeric acid-reacting layer which is typically coated as an organic-based composition comprises a mixture of a half butyl ester of polyethylene/maleic anhydride copolymer with polyvinyl butyral. A suitable water-based composition for the provision of polymeric acid-reacting layer 18 comprises a mixture of a water-soluble polymeric acid and a water-soluble matrix or binder material. Suitable water-soluble polymeric acids include ethylene/maleic anhydride copolymers and poly(methyl vinyl ether-co-maleic anhydride). Suitable water-soluble binders include polymeric materials such as polyvinyl alcohol, partially hydrolyzed polyvinyl acetate, carboxymethyl cellulose, hydroxyethyl cellulose, hydroxpropyl cellulose, polymethylvinylether or the like, as described in U.S. Pat. No. 3,756,815. As examples of useful polymeric acid-reacting layers, in addition to those disclosed in the aforementioned U.S. Pat. Nos. 3,362,819, mention may be made of those disclosed in the following U.S. Pat. Nos.: Bedell, 3,765,885; Sahatjian, et al., 3,819,371; Haas, 3,833,367; Taylor, 3,754,910 and Schlein, 3,756,815.

In the image-receiving element of FIG. 2 is shown a timing layer 22 which is included for the control of the pH-reducing properties of the polymeric acid-reacting layer. Timing (or spacer) layer 22 will comprise polyvinyl alcohol, gelatin or other polymer through which the alkali may diffuse to the polymeric acid-reacting layer. The presence of such a timing layer between the image-receiving layer 24a and the acid-reacting layer 18 efficiently controls the initiation and the rate of capture of alkali by the acid-reacting layer. Suitable materials for the formation of timing layers and the advantages thereof in diffusion transfer systems are described with particularity in U.S. Pat. Nos. 3,362,819; 3,419,389; 3,421,893; 3,455,686; 3,577,237 and 3,575,701.

Shown in the article of FIG. 2 is overcoat 26 which comprises an optional layer of image-receiving element 20a. In some instances, it may be desirable to provide layer 26 as a means of facilitating separation of image-receiving element 20a from a photosensitive element. Thus, where the image-receiving element is used in a photographic film unit which is processed by distribution of an aqueous alkaline processing composition between the image-receiving element and a photoexposed photosensitive element and is adapted, after formation of a dye image, to separation from the developed photosensitive element and the processing composition, overcoat layer 26 can effectively function as a "strip coat". The diffusion transfer photograph produced from image-receiving element 20a may , thus, additionally include on its surface a residue of the overcoat stripping layer used to facilitate the peeling apart of the elements. The stripping layer can be formed by coating the image-receiving layer 24a with a solution of ammonia and a hydrophilic colloid (usually gum arabic), as described in the aforementioned U.S. Pat. No. 4,322,489 and in U.S. Pat. No. 4,009,031 (issued Feb. 22, 1977 to D.P. Carlson).

The image-receiving elements of the present invention are adapted to use in so-called "peel-apart" diffusion transfer film units designed to be separated after processing. Such a diffusion transfer film unit of the invention is shown in FIG. 3 as film unit 30. For ease of understanding, the film unit shown in FIG. 3 illustrates the formation of a monochrome image using a single dye developer. Thus, in the film unit 30 of FIG. 3, there is shown a photosensitive element 32 which comprises an opaque support 32*a* carrying a layer 34 of a dye developer over which is applied a silver halide emulsion layer 36. In film units of this type, photosensitive element 32 is photoexposed and is brought into a superposed relationship with image-receiving element 20*a*, with a rupturable container 28 (holding an aqueous alkaline processing composition 28*a*) so positioned as to discharge its contents between said elements upon suitable application of pressure, as by passing the film unit through a pair of pressure applying camera rolls or other pressure-applying means (not shown). As is well known in diffusion transfer processing, passage of the film unit through a pair of rollers to rupture the rupturable pod 28 effects a uniform distribution of processing composition 28*a* as a layer between the photosensitive and image-receiving elements and, after a suitable and predetermined imbibition period and desired image formation, the photosensitive and image-receiving elements are separated or peeled apart for production of a diffusion transfer photograph 20*b*, shown in FIG. 4.

It will be appreciated that in a film unit as illustrated in FIG. 3, light piping effects may be observed where sheet member 16*a* is a transparent sheet member and where the film unit, after the spreading photographic processing composition 28*a*, is brought into daylight for imbibition and desired image formation. Accordingly, it will be desirable to include one or more opacification agents in processing composition 28*a* to provide protection of photosensitive element 32 against undesired fogging. Suitable opacification dyes are known in the photogrpahic diffusion transfer art and examples thereof ae described, for example, in U.S. Pat. No. 3,647,437 (issued Mar. 7, 1972 to E.H. Land) and in U.S. Pat. No. 4,298,674 (issued Nov. 3, 1981 to E.H. Land, et al.).

In film unit 30 of FIG. 3, single dye developer and silver halide emulsion layers for production of a monochrome film are illustrated. Multicolor images may be obtained by providing a plurality of differently sensitized emulsion layers coated in a superposed relationship. Film units intended to provide multicolor images comprise two or more selectively sensitized silver halide layers, each having associated therewith an appropriate image dye-providing material providing an image dye having spectral absorption characteristics substantially complementary to the light by which the associated silver halide is exposed. The most commonly employed negative components for forming multicolor images are of the "tripack" structure and contain blue-, green- and red-sensitive silver halide layers each having associated therewith in the same or in a contiguous layer a yellow, magenta and a cyan image dye-providing material, respectively. Interlayers or spacer layers may, if desired, be provided between the respective silver halide layers and associated image dye-providing materials or between other layers. Multicolor photosensitive elements of this general type are known in the diffusion transfer photographic art and are described, for example, in U.S. Pat. No. 2,983,606 (issued May 9, 1961 to H. G. Rogers) and in U.S. Pat. No. 3,345,163 (issued Oct. 3, 1967 to E.H. Land et al.).

Multicolor photosensitive elements useful in film units of the type shown in FIG. 3 are commercially available; and such photosensitive elements as are used in Polacolor 2, T-108 film (from Polaroid Corporation, Cambridge, Mass.) can be used with good results.

In photograph 20*b*, prepared from image-receiving element 20*a* of film unit 30, the dye image resides in image-bearing layer 24*b*. The entire photograph, or any portion cut therefrom, can be separated between the support members of the two-sheet composite support thereof, in the manner shown in FIG. 4. Stripped element 12 will be discarded to waste and adhesively bondable photograph 16 (a transparency, as shown in FIG. 4) can be adhesively bonded via adhesive layer 14 to a desired substrate material.

After separation of support 12 from photograph 20*b* —to provide the desired adhesively bondable photograph 16—the adhesive layer of photograph 16 can be brought into contact with any of a variety of substrate materials for adhesion thereto. Paper, glass, china, metal, plastic and other substrate materials can be provided with a photograph in this manner. The particular method used to effect adhesion of photograph 16 to the substrate material will depend largely upon the particular nature of adhesive layer 14 and on the nature of the substrate material, and particularly, upon the adaptability of the substrate material to the application of pressure and/or heat.

Laminable substrate materials, such as flexible sheet materials of paper, plastic or the like, are especially suited to receiving a photograph 16 by conventional lamination methods. Thus, adhesive layer 14 can be placed into contact with one or both surfaces of a laminable sheet material, and the resulting composite can be laminated between heated platens or rolls for production of a securely bonded photograph to either or both surfaces of the substrate material.

An important feature of image-receiving element 20*a* of the invention, and of the photograph 16 produced therefrom, is the thinness of support material 16*a*. The use of a thin support material 16*a* allows for lamination of photograph 16 to a substrate material in a manner which creates the appearance of the photograph being unitized with the substrate material or of being an integral part thereof. In addition, an attempt to remove the adhered photograph from the substrate material will likely result in stretching, mutilation or like damage to the photograph so as to make evident the attempted removal. Such a feature is especially desired in security applications where personalized information pertaining to the holder of an identification card, credit card or other information-bearing document is to be applied to the document by application of a photograph 16 thereto.

Figure 5:
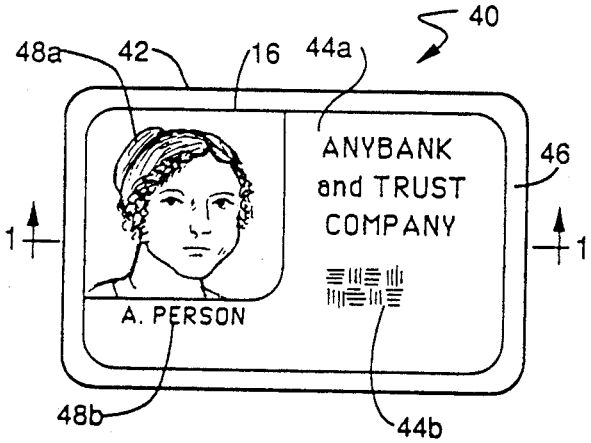
FIG. 5 is a plan view of a plastic identification document comprising a plastic cardstock material carrying the adhesively bonded photograph of FIG. 4.

In FIG. 5 is shown a plastic credit card (before application of embossed indicia conventionally applied thereto) carrying a laminated photograph 16. In credit card 40, a plastic cardstock material 42 of polyvinyl chloride or other suitable plastic material carrying preprinted indicia 44*a* and 44*b* is provided with a laminated photograph 16. Laminated photograph 16 includes personalized photographic information such as a likeness 48*a* of the card carrier and identifying information 48*b*. Preferably, photograph 16 will be cut to slightly smaller dimensions than cardstock material 42 resulting in a peripheral or margin area 46 about photograph 16.

Photograph 16 can be applied with the aid of a pair of heated platens, rollers or the like, preferably conducted so as to avoid entrapment of air between photograph 16 and cardstock material 42. Depending upon the nature of cardstock material 42, and particularly the thermoplastic properties thereof, it maybe desirable to laminate a thin photograph 16 to the card in a manner such that the photograph 16 is embedded into the cardstock material 42, as can be seen from FIG. 6. Such a construction has the advantage that the periphery of photograph 16 cannot be felt and cannot be used as a means for grasping or otherwise lifting the photograph from the cardstock material. This preferred construction can be accomplished by lamination in a pouch designed by apertures therein to localize the application of heat at the edges of the photograph and to embed at least the edges of the photograph into the thermoplastic card material. Laminating envelopes or pouches having apertures therein can be particularly adapted to the particular size and shape of the photograph to be applied to a thermoplastic substrate material.

Figure 6:
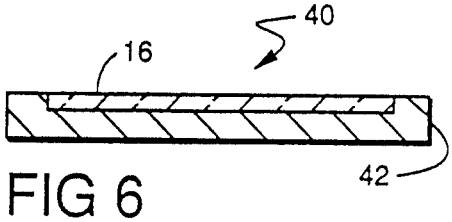
FIG. 6 is a cross-sectional view of a preferred embodiment of the identification document of FIG. 5, taken along the line 1—1, showing the adhesively bonded photograph embedded into the plastic cardstock material.
Figure 7:
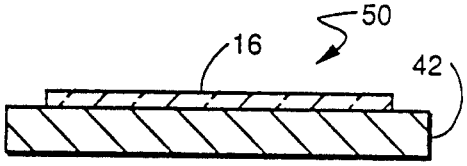
FIG. 7 is a cross-sectional view of another embodiment of a plastic identification document of FIG. 5, taken along the line 1—1, showing the adhesively bonded photograph laminated to the surface of the plastic cardstock material.

Another embodiment of a personalized identification document of the type shown in FIG. 5 is shown in FIG. 7. In article 50, adhesively bondable photograph 16 is shown laminated to one surface of cardstock material 42. The lamination can be conducted by resort to known lamination methods. The photograph, while not embedded into the cardstock material 42 can be securely laminated to the card by such methods. The thin photograph, where strongly adhered to the substrate, is distorted or otherwise shows evidence of an attempted removal. It will be appreciated that a construction as shown in FIG. 6 will be especially preferred where security and resistance to tampering are desired.

Removability of the adhesively bonded photograph from the substrate material may be desired in other applications where security considerations are neither paramount nor important, and for such applications, it will be desirable that the adhesively bonded photograph be only weakly bonded to the substrate—so that the photograph can be peeled or removed from the substrate material. It will be appreciated that the strength of the bond between the adhesively bonded photograph and the substrate can be made to vary to suit the requirements of particular applications.

The following examples are provided to further illustrate the invention. It will be understood that the examples are intended to be illustrative and not limiting in nature. All parts and percentages are by weight unless otherwise specified.

EXAMPLE 1

An image-receiving element for use in a photographic diffusion transfer film unit of the "peel-apart" type, and for the production of an adhesively bondable diffusion transfer photograph, was prepared in the following manner.

A supply of polyethylene-clad paper sheet material having a thickness of about 5 mils (0.127 mm) and comprising a paper core member carrying a white titanium dioxide-pigmented polyethylene layer on one side and an opaque (black) carbon-pigmented polyethylene layer on the opposed side, was coated on the white side with a layer of heat-activatable adhesive. The adhesive material (a polyester-based adhesive composition comprising solids at a level of about 12% by weight in an organic solvent, and available as Adhesive No. 72-9672 from National Starch Company) was slot coated and dried to an adhesive layer of about 0.3 mil (0.0076 mm) thickness, to provide an adhesive-carrying base sheet material.

A supply of clear polyester sheet material of about 1.42 mils (0.036 mm) thickness, subcoated on each side with adhesion-promoting layers, was brought into engagement with the adhesive layer of the aforedescribed adhesive-carrying base sheet material at the nip of a pair of heated rolls (heated to about 93.3° C). Upon passage of the sheet materials through the rollers, there was obtained a two-sheet laminate suited, by application of image-receiving layers, to production of an image-receiving element. The adhesivity of the base sheet material to the adhesive layer was less than the cohesive strength of the adhesive layer and less than the adhesivity of the clear polyester sheet material to the adhesive layer, such that, when a sample of the two-sheet laminate was separated by peeling, the heat-activatable adhesive was preferentially laminated (transferred) to the clear polyester sheet material.

A tie-coat layer (coated as a 5% by weight solution of polyvinyl butyral resin in isopropyl acetate and methanol, and dried to a layer of about 0.0038 mm thickness) was applied to the clear polyester side of the aforedescribed two-sheet laminate. In order, the following additional layers were applied, to provide an image-receiving element:

1. a mixture of about eight parts of a partial butyl ester of polyethylene/maleic anhydride and about one part of polyvinyl butyral resin coated to a coverage of about 21,528 mg/m$^2$ to form an acid-reacting polymeric layer;

2. a mixture of about seven parts of hydroxy-propyl cellulose (Klucel J12HB, Hercules, Inc., Wilmington, Del.) and about four parts polyvinyl alcohol, coated to a coverage of about 9,688 mg/m$^2$ to form a timing layer;

3. a mixture of about two parts of polyvinyl alcohol and one part of poly (4-vinyl pyridine), coated to a coverage of about 8,396 mg/m$^2$ to provide an image-receiving layer, also containing an equimolar mixture of the cis- and trans- isomers of 4,5 cyclopentahexahydropyrimidine-2-thione (described in U.S. Pat. No. 3,785,813, issued Jan. 15, 1974 to D. O. Rickter) as a development restraining reagent and hardened by a condensate of acrolein and formaldehyde; and 4. a stripping overcoat layer formed by coating a gum arabic/ammonia solution (about two parts ammonium hydroxide) at a total solids coverage of about 323 mg/m$^2$.

EXAMPLE 2

Using the image-receiving element described in EXAMPLE 1, a photographic diffusion transfer film unit and an adhesively bondable diffusion transfer photograph were prepared in the following manner. The image-receiving element was combined with a photosensitive element (commercially available in Polacolor 2, T-108 film, from Polaroid Corporation, Cambridge, Mass.) to form a film unit. The image-receiving and photosensitive elements of the film unit were interconnected such that they could after photoexposure of the photosensitive element be brought into face-to-face relation; and a rupturable container (containing aqueous alkaline, opacified processing composition) was affixed to the leading edge of the elements, such that, upon application of compressive pressure to the container, the contents thereof would be distributed, upon rupture of the marginal seal of the container, between the surface layers of the photosensitive and image-receiving elements.

The film unit was inserted into the camera of a Polaroid ID-3 system, designed to simultaneously photograph the bearer of an ID card and a data card placed into the camera carrying personalized data relating to the bearer. The photosensitive element was photoexposed in the camera to the subject and the data card, whereupon, the photoexposed element and the image-receiving element were brought into superposition. The film unit was passed through the camera rollers (thereby rupturing the pod of processing composition and distributing the contents uniformly therebetween) and pulled from the camera. After maintaining the superposed elements in superposed relation for a 90-second imbibition period, the photosensitive and image-receiving elements were stripped apart to provide a diffusion transfer photograph of the subject and the personalized information of the data card.

The resulting diffusion transfer photograph was die cut to the configuration of a conventional plastic credit card, except that, the size was somewhat smaller, so that, when placed onto a standard-size credit card, the photograph would substantially cover the surface area of the card except for a marginal or rim area about the periphery of the card. The die cut photograph was separated at the base of the photograph by peeling the image-carrying polyester sheet member from the base member, the heat-activatable adhesive being preferentially adhesive to the polyester sheet—to provide a thin adhesively bondable transparency.

EXAMPLE 3

A thin adhesively bondable photograph was affixed to a PVC/PVA substrate material (a white polyvinyl chloride/polyvinyl alcohol sheet member of 90/10 PVC/PVA copolymer, cut to a standard, credit-card size) in the following manner. The thin adhesively bondable transparency prepared in the manner described in EXAMPLE 2 was positioned (adhesive side down) onto the PVC/PVA card member. The resulting superposed elements were placed (photograph side down) into a two-component lamination envelope carrier, the inner side of one of the two sheet components of the carrier envelope having a well or recess configured to the dimensions of the PVC/PVA card (to restrict thermoplastic flow). The lamination carrier (having the card-and-photograph combination positioned in the well of the carrier) was fed directly through the rollers of a roll laminator and into contact with a heated platen which applied heat to the element of the carrier having the PVC/PVA card/photograph in the well thereof. The platen was heated to approximately 190–205° C. The residence time of the carrier in contact with the platen of the laminator was about 15 seconds. The element of the laminate carrier in contact with the platen was provided with elongated slots to provide localized heating about the periphery of the photograph positioned on the PVC/PVA card. On removal from the lamination carrier, there was provided a PVC/PVA card element having a transparency embedded into the card. Thumb-nail testing for the edge of the photograph showed that the polyester-based transparency had been embedded into the card providing the appearance and feel of a unitized element.

EXAMPLE 4

Using the procedure described in EXAMPLE 3, a card carrying an embedded transparency was prepared from a three-ply construction PVC/PVA card. The cardstock material comprised an inner core (sheet) of white PVC/PVA (90/10 copolymer) sandwiched between a pair of transparent PVC/PVA (90/10 copolymer) sheets, the three sheet elements having been heated under pressure according to known card manufacturing methodology. The photographic transparency laminated into the card appeared to have been embedded into the card at the periphery of the transparency.

EXAMPLE 5

An image-receiving element of the construction described in EXAMPLE 1 was prepared by the following sequence of steps.

A polyethylene-clad paper sheet was coated with adhesive and dried to provide the adhesive-carrying base sheet material described in EXAMPLE 1. A supply of clear polyester sheet material, as described therein, was provided first with a tie-coat layer, as described therein, and, then (in order, over the tie-coat) with layers 1, 2, 3 and 4, as described therein. The adhesive side of the adhesive-carrying base sheet material and the uncoated side of the polyester sheet material carrying the tie coat and image layers were brought into contact at the nip of the heated rollers and passed through the rollers for production of the desired image-receiving element.

Using the procedures described in EXAMPLES 2 to 4, PVC/PVA credit cards having an adhesively bondable photograph embedded therein were prepared.

EXAMPLE 6

A diffusion transfer photograph, adhesively bondable by a pressure-sensitive adhesive to a credit card material, was prepared in the following manner.

A polyethylene-clad paper sheet material as described in EXAMPLE 1, was coated (onto the white side) with a layer of polyacrylic-based pressure-sensitive adhesive and the adhesive was partially dried to a layer of about 0.5 mil (0.013 mm) thickness, to provide an adhesive-carrying base sheet material. The resulting base sheet material was brought into adhesive contact (at the nip of a pair of heated rolls) with a supply of clear polyester sheet material of about 0.92 mil (0.023 mm) thickness, subcoated on each side with adhesion-promoting layers. On passage through a pair of heated rollers, there was obtained a two-sheet composite material. The adhesivity of the base sheet material to the pressure-sensitive adhesive layer was less than the cohesive strength of the adhesive layer and less than the adhesivity of the clear polyester sheet material to the adhesive layer. As a consequence, upon separation of the sheets of a sample of the two-sheet composite material, the pressure-sensitive adhesive was preferentially laminated (transferred) to the clear polyester sheet material.

Tie-coat and image-receiving layers, as described in EXAMPLE 1, were applied to the untreated-polyester side of the two-sheet composite material—to provide an image-receiving element.

An adhesively bondable photograph was prepared using the procedure of EXAMPLE 2, except that, the aqueous alkaline processing composition contained no opacification agent and processing was performed in the dark to avoid fogging. The resulting photograph, on separation from the negative, was die cut to the same dimensions as a PVC card having an inner core of magnetic oxides. The die cut photograph was separated at the base of the photograph by peeling the image-carrying polyester sheet member from the base member, the pressure-sensitive adhesive being preferentially adhesive to the polyester sheet—to provide a thin adhesively bondable transparency.

The adhesively bondable transparency was brought into adhesive contact with the aforedescribed PVC card and the elements were cold laminated by passage through the rollers (at room temperature) of a pressure-roll laminator—to provide a credit card having a thin photographic transparency adhesively bonded thereto.

EXAMPLE 7

Using the procedures described in EXAMPLE 6, a photographic transparency was prepared. The photograph, on separation from the negative, was die cut to dimensions slightly smaller than those of a plastic RF-emitting access card, so as to provide a border about the access card. The die cut transparency was separated from the base member in the manner described in EXAMPLE 6 and the transparency was cold laminated to the access card in the manner therein described.

Since certain changes may be made in the aforedescribed embodiments of the present invention without departing from the scope of the invention herein involved, it is intended that all matter contained in the above description shall be interpreted as illustrative and not in a limiting sense.

What is claimed is:

1. An image-receiving element adapted to the production of a diffusion transfer photograph bondable adhesively and securely to an information-bearing document, said image-receiving element comprising first and second sheet-like support members adhesively bonded to one another by a layer of heat-activatable adhesive therebetween, the adhesivity of said first sheet-like support to said adhesive layer being less than the adhesivity of said second sheet-like support to said adhesive layer and being less than the cohesivity of said adhesive layer, said second sheet-like support member carrying on the side thereof opposed from said adhesive layer at least a water-permeable and dyeable image-receiving layer adapted to receive a photographic dye image by diffusion transfer processing, said heat-activatable adhesive being adapted by heat lamination to the secure adhesion of said photograph to the surface of an information-bearing document.

2. The image-receiving element of claim 1 wherein said second sheet-like support member carries on said side thereof opposed from said adhesive layer, in order, a polymeric acid-reacting layer, a polymeric timing layer through which alkali may pass to said polymeric acid-reacting layer, and said water-permeable and dyeable image-receiving layer.

3. The image-receiving element of claim 2 wherein said water-permeable and dyeable image-receiving layer comprises a mixture of polyvinyl alcohol and poly-4-vinylpyridine.

4. The image-receiving element of claim 3 wherein said polyvinyl alcohol and said poly-4-vinylpyridine are present in a weight ratio of from 3:1 to 1:3.

5. The image-receiving element of claim 1 wherein said second sheet-like member is transparent.

6. The image receiving element of claim 5 wherein said transparent sheet-like member comprises a polyester.

7. The image-receiving element of claim 6 wherein said polyester comprises polyethylene terephthalate.

8. The image-receiving element of claim 5 wherein said first sheet-like support member is an opaque paper support member.

9. The image-receiving element of claim 1 wherein said second sheet-like support member has a thickness in the range of from 0.0064 to 0.076 mm.

10. The image-receiving element of claim 9 wherein said second sheet-like support member comprises polyethylene terephthalate.

11. The image-receiving element of claim 10 wherein said heat-activated adhesive material comprises a polyester adhesive material.

12. A photographic diffusion transfer film unit comprising photosensitive and image-receiving elements adapted to separation after photographic diffusion transfer processing, said film unit comprising, in combination:

a photosensitive element including at least a silver halide emulsion layer having associated therewith a diffusion transfer process dye-image providing material;

an image-receiving element comprising first and second sheet-like support members adhesively bonded to one another by a layer of heat-activatable adhesive material therebetween, the adhesivity of first sheet-like support to said adhesive layer being less than the adhesivity of said second sheet-like support to said adhesive layer and being less than the cohesivity of said adhesive layer, said second sheet-like support member carrying on the side thereof opposed from said adhesive layer at least a water-permeable and dyeable image-receiving layer adapted to receive a photographic dye image by said photographic diffusion transfer processing, said heat-activatable adhesive upon production of a photograph after said separation being adapted by heat lamination to secure adhesion of said photograph to the surface of an information-bearing document; and an alkaline processing composition adapted to distribution between said photosensitive and image-receiving elements upon photoexposure of said photosensitive element.

13. The photographic diffusion transfer film unit of claim 12 wherein said photosensitive element comprises an opaque support carrying at least two selectively sensitized silver halide emulsion layers, each associated with an image dye processing spectral absorption characteristics substantially complementary to the predominant sensitivity range of its associated emulsion.

14. The photographic diffusion transfer film unit of claim 13 wherein said opaque support carries blue-sensitive, green-sensitive and red-sensitive silver halide emulsion layers, each of said silver halide emulsion layers having associated therewith in the same or in a contiguous layer a yellow, a magenta and a cyan image dye-providing material, respectively.

15. The photographic diffusion transfer film unit of claim 14 wherein said first sheet-like support member of said image-receiving element comprises an opaque paper.

16. The photographic diffusion transfer film unit of claim 15 wherein said second sheet-like support member of said image-receiving element is transparent polymeric sheet-like member.

17. The photographic diffusion transfer film unit of claim 16 wherein said transparent polymeric sheet-like member comprises polyethylene terephthalate.

18. The photographic diffusion transfer film unit of claim 17 wherein said polyethylene terephthalate sheet-like member has a thickness in the range of 0.0064 to 0.076 mm.

19. The photographic diffusion transfer film unit of claim 16 wherein said second sheet-like support member of said image-receiving element carries on said side thereof opposed from said adhesive layer, in order, a polymeric acid-reacting layer, a polymeric timing layer through which alkali may pass to said polymeric acid-reacting layer, and said water-permeable and dyeable image-receiving layer.

20. The photographic diffusion transfer film unit of claim 19 wherein said water-permeable and dyeable image-receiving layer comprises a mixture of polyvinyl alcohol and poly-4-vinylpyridine.

21. A method for applying an adhesively and securely bondable photograph to the surface of an information-bearing document, for the enhancement of the security thereof, which comprises the steps of:

imagewise exposing a photosensitive element including a support and at least a silver halide emulsion layer having associated therewith a diffusion transfer process dye-image providing material;

superposing said imagewise exposed photosensitive element in face-to-face relation with the image-receiving layer of an image-receiving element, said image-receiving element comprising first and second separable sheet-like support members adhesively bonded to one another by a layer of heat-activatable adhesive therebetween, the adhesivity of said first sheet-like support to said adhesive being less than the adhesivity of said second sheet-like support to said adhesive layer and being less than the cohesivity of said adhesive layer, said second sheet-like support member carrying on the side thereof opposed from said adhesive layer at least said image-receiving layer, said image-receiving layer being a water-permeable and dyeable layer adapted to receive a photographic dye image by diffuson transfer processing;

applying an aqueous alkaline processing composition between said superposed photosensitive and image-receiving elements;

separating said superposed photosensitive and image-receiving elements after a predetermined imbibition period and development of said photographic dye image in said image-receiving layer;

separating said first and second separable sheet-like support members of said image-receiving element, said adhesive layer being preferentially adhered to said second sheet-like support member, thereby to provide an adhesively bondable diffusion transfer photograph comprising said second sheet-like support member carrying said photograph on one side and said adhesive layer on the opposed side thereof; and adhering said adhesively bondable photograph to said document by contacting said heat-activatable adhesive layer with the surface of said information-bearing document and heat laminating said photograph to said document, thereby to enhance the security of said information-bearing document.

22. The method of claim 21 wherein said first sheet-like support member of said image-receiving element comprises an opaque paper support.

23. The method of claim 22 wherein said second sheet-like support member of said image-receiving element comprises a transparent polymeric support.

24. The method of claim 23 wherein said photosensitive element comprises an opaque support carrying at least two selectively sensitized silver halide emulsion layers, each associated with an image dye-providing material which provides an image dye possessing spectral absorption characteristics substantially complementary to the predominant sensitivity range of its associated emulsion.

25. The method of claim 24 wherein said information-bearing document comprises a thermoplastic polymeric sheet-like substrate.

26. The method of claim 25 wherein said adhesively bondable photograph is at least in part embedded into said thermoplastic polymeric substrate by said heat lamination.

27. The method of claim 26 wherein said thermoplastic polymeric substrate comprises a polyvinyl chloride credit card.

* * * * *